United States Patent [19]

Fahmueller

[11] Patent Number: 4,738,005

[45] Date of Patent: Apr. 19, 1988

[54] ADJUSTING DEVICE FOR OPERATING ELEMENTS OF CARDS OR CARDING ROLLERS

[75] Inventor: Maximillian Fahmueller, Ingolstadt, Fed. Rep. of Germany

[73] Assignee: Schubert & Salzer, Ingolstadt, Fed. Rep. of Germany

[21] Appl. No.: 4,163

[22] Filed: Jan. 15, 1987

[30] Foreign Application Priority Data

Jan. 23, 1986 [DE] Fed. Rep. of Germany ..... 3601906

[51] Int. Cl.[4] ..... D01G 15/12; D01G 15/28; D01G 15/30

[52] U.S. Cl. ..... 19/103

[58] Field of Search ..... 19/98, 103, 111

[56] References Cited

U.S. PATENT DOCUMENTS

| | | | |
|---|---|---|---|
| 494,422 | 3/1893 | Hitchon | 19/103 |
| 564,125 | 7/1896 | Tweedale | 19/103 |
| 1,015,835 | 1/1912 | Potter | 19/103 X |

FOREIGN PATENT DOCUMENTS

| | | | |
|---|---|---|---|
| 0257170 | 2/1913 | Fed. Rep. of Germany . | |
| 0006666 | of 1892 | United Kingdom | 19/103 |
| 0344220 | 3/1931 | United Kingdom | 19/103 |

*Primary Examiner*—Louis K. Rimrodt
*Attorney, Agent, or Firm*—Dority & Manning

[57] ABSTRACT

An adjustment device is provided with a regulating element and with a bearing which receives the operating element. The bearing is supported on a fixed guiding surface and, by means of an adjustment surface, on the regulating element. The bearing can be moved along the guiding surface in an adjustment plane by means of the regulating element. The regulating element engages nearly symmetrically on the adjustment surface which extends up to the guidance surface, and can be swivelled in the direction of the adjustment plane. Precise guidance and adjustment of the operating element without jamming thereof during adjustment is thereby made possible.

19 Claims, 2 Drawing Sheets

ADJUSTING DEVICE FOR OPERATING ELEMENTS OF CARDS OR CARDING ROLLERS

BACKGROUND AND SUMMARY OF THE INVENTION

This invention generally concerns an adjusting device for work elements and particularly elements of cards or carding rollers equipped with a regulating element and a bearing which it bears with a locating face against a fixed guiding surface and with an adjustment surface against such regulating element, and which can be moved by the regulating element in a direction of adjustment along a guiding surface.

In carding devices the garniture rollers are equipped with machine elements such as for example tops, grates and stripping-off plates . The distance between such elements and the rollers must be adjusted with great precision to obtain good carding results. The adjustment is obtained by means of regulating elements of various designs, but in the simplest manner by means of adjustment screws.

A known proposal, for example, provides for the flexible sliding arch in fillet cards to be held at a certain number of points by radially oriented adjustment screws seated on the lateral arch or lateral screen (DE-PS No. 257.170). An adjustment surface of the sliding arch which lies between two fixed guiding surfaces is in contact with the heads of the adjustment screws, said sliding arch being attached to the lateral screen by means of screws. When these screws are loosened, the sliding arch, and thereby the distance between the top garniture and the garniture of the carding drum can be adjusted by means of adjustment screws. However, there remains the danger that the sliding arch, which must have clearance between its guiding surfaces, may become jammed during adjustment. Precise guidance and adjustment of the sliding arch is therefore not ensured.

It is an object of the instant invention to provide a device making it possible to guide and adjust the machine elements of cards or carding rollers with precision.

Such object is achieved in one exemplary embodiment of this invention by means of an adjustment device for operating elements of cards or carding rollers comprising a regulating element and a bearing for the operating element, supported on a fixed guidance surface and, by means of an adjustment surface, on the regulating element, and which is movable along the guidance surface in an adjustment direction by means of the regulating element in that the regulating element engages nearly symmetrically on the adjustment surface which reaches up to the guidance surface, and in that the regulating element can be swivelled in the direction of an adjustment plane.

In a preferred further embodiment of the inventive device the regulating element includes an adjustment screw, the free end of which is received by a rotatably installed bolt. The bolt is suitably supported in an adjustment head provided for the adjustment surface. The adjustment head is attached to the adjustment surface or is preferably an integral component of the bearing, whereby said bolt is in direct contact with the adjustment surface. In a further embodiment of the invention the bolt is cylindrical. More precisely defined bearing locations are created by providing side rims on the bolt. The side rims can be ground flat or can be crowned.

In still a further embodiment, the bolt is pivotably supported in frames that are arranged symmetrically in relation to the adjustment surface, and is connected rigidly to a holding device which receives the free end of the adjustment screw. However, it is also possible for the bolt to be supported pivotably in a frame which is centered in relation to the adjustment surface and for said bolt to be attached in a holding device which extends beyond the frame and receives the free end of the adjustment screw. In order to avoid deformation of the adjustment screw as it is attached to a fixed machine part, said adjustment screw is gripped in ball sockets at this machine part.

BRIEF DESCRIPTION OF THE DRAWINGS

Examples of embodiments of the invention are described in the following specification in conjunction with the accompanying drawings, in which.

Figure 1:
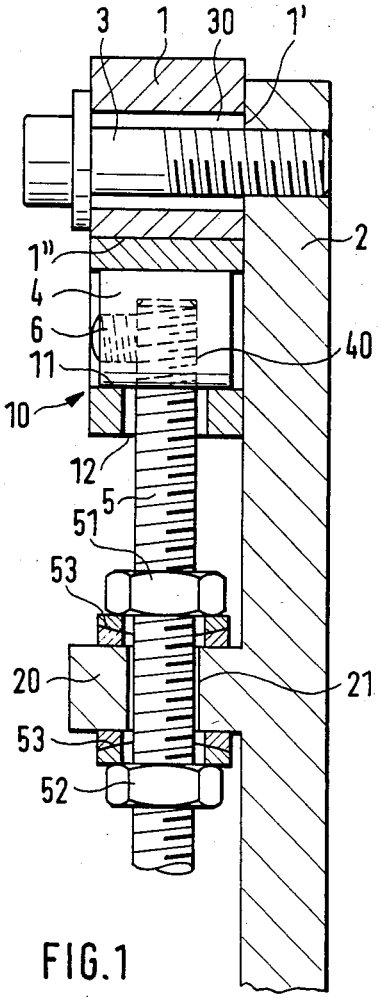
FIG. 1 shows a cross-section of a top sliding arch with an exemplary adjustment device according to this invention.

Repeat use of reference characters in the following specification and drawings is generally intended to indicate same or analogous features or elements of the invention.

DETAILED DESCRIPTION OF THE PREFERRED EMBODIMENTS

The invention is described hereinbelow in connection with the adjustment of a top sliding arch which determines the distance between the top garniture and the garniture of a drum. The invention is however applicable also to the adjustment of other operating elements of cards or carding rollers, for example for carding segments and grates.

FIG. 1 shows a bearing 1 which, in the example shown, includes a sliding arch on which the rotating tops of a carding machine are supported in a known manner (therefore not shown). The bearing 1 bears against a fixed guiding surface 1' on the lateral screen 2 of the carding machine and is attached to it by means of a disk 3 extending through an oblong orifice 30. At an adjustment surface 1'' of bearing 1 an adjustment head 10, extending over the width of adjustment surface 1'', is attached for a regulating element against which bearing 1 is bearingly supported.

The regulating element contains a bolt 4 which is rotatably supported in a crosswise bore 11 of the adjustment head 10, said bolt being provided with a radial bore 40. The regulating element also contains an adjustment screw 5. The adjustment screw 5 is set in a bore 21 provided in the radial plane of bearing 1 in an outwardly oriented frame 20 of the lateral screen 2, said adjustment screw 5 being secured against shifting by means of nuts 51 and 52. To avoid deformation of the adjustment screw 5, said adjustment screw 5 is gripped in ball sockets 53. The adjustment screw 5 extends through a bore 12, in alignment with bore 21, in the adjustment head 10 and into a radial bore 40 of bolt 4 which is essentially centered in relation to adjustment surface 1'' of bearing 1. Bore 40 is a threaded bore. The free end of adjustment screw 5, provided with outer threading, is screwed into bore 40 and is secured against twisting by means of a screw 6. The diameter of bore 21 in frame 20 and the diameter of bore 12 in adjustment head 10 are greater than the outer diameter of the adjustment screw 5. The adjustment screw 5, held in the rotatably supported bolt 4 can therefore be swivelled in the direction of the adjustment plane during the adjusting process.

When screw 3 is loosened, bearing 1 can be adjusted through the adjustment of nuts 51 and 52 on the adjustment screw 5, and thereby it is possible to determine the distance between the garniture of the top which is resting on bearing 1 and the drum garniture. Here, the regulating element in the described embodiment and arrangement engages nearly symmetrically on the adjustment surface 1'' of bearing 1 extending up to the fixed guidance surface 1', so that jamming of bearing 1 during the adjustment process is excluded and precise sliding of bearing 1 along guidance surface 1' on the lateral screen 2 is ensured. Since the adjustment screw 5 can be swivelled in direction of the adjustment plane, irregularities in the lateral screen can be compensated for. The adjustment element described exists of course at several locations of the sliding arch constituting bearing 1.

Figure 2:
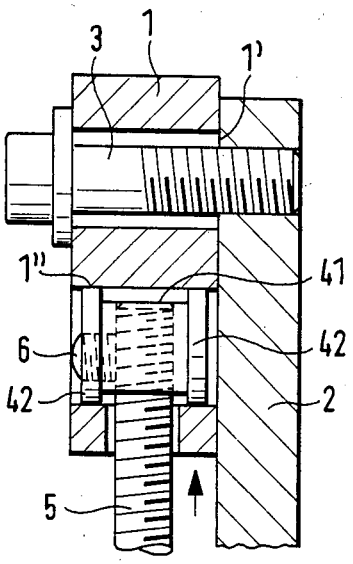
FIGS. 2 to 5 show further embodiments of an adjustment device in accordance with this invention.

In the embodiment given as an example in FIG. 2 the adjustment head 10 is an integral component of bearing 1. A bolt 41 is pivotably supported in the adjustment head. Bolt 41 is provided with lateral rims 42 by which it is in direct contact with the adjustment surface 1 of bearing 1. The support locations for bolt 41 and bearing 1 are defined through the lateral rims 42 which are suitably ground flat so that they are flush with adjustment surface 1'' of bearing 1. The free end of adjustment screw 5 is attached in the middle of bolt 41 as in the device of FIG. 1.

Figure 3:
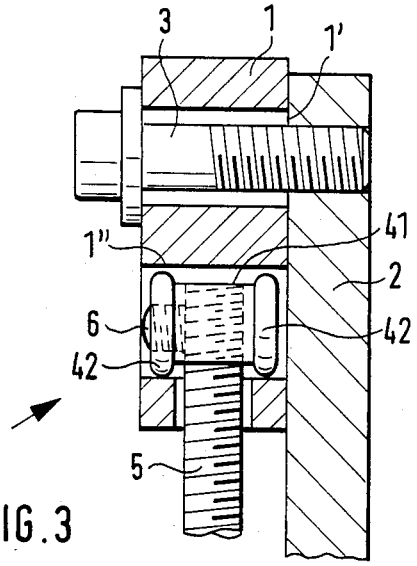

The embodiment given as example in FIG. 3 is different from that in FIG. 2 in that the lateral rims 42 are crowned. In this way even more precisely defined support locations are obtained.

Figure 4:
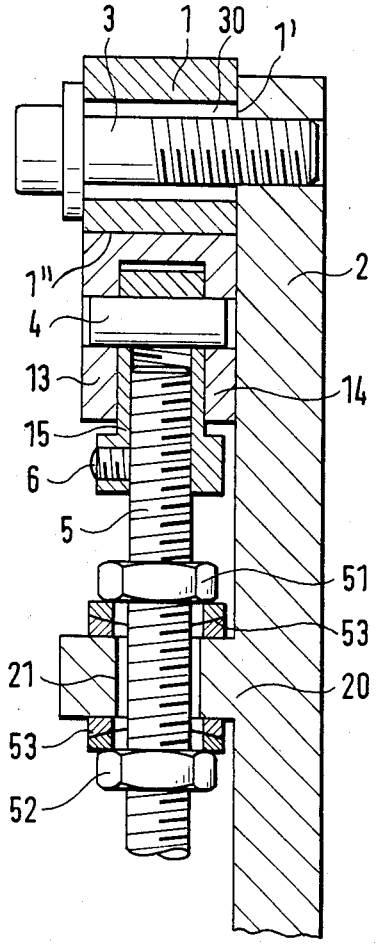
Figure 5:
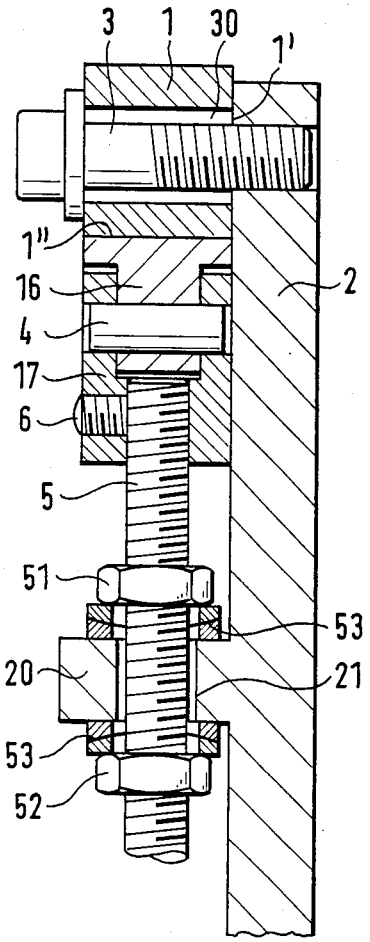

In FIGS. 4 and 5 the same reference numbers as those of FIG. 1 are used for referring to the same device parts. In the embodiment given as example in FIG. 4, frames 13 and 14 are placed symmetrically with respect to adjustment surface 1'' and a holding device 15 is inserted with some clearance between these frames. Bolt 4 is rigidly inserted in holding device 15 and is rotatably supported in the frames 13 and 14. Holding device 15 furthermore receives the free end of adjustment screw 5. In this manner the regulating element engages nearly symmetrically at the adjustment surface 1'' in this embodiment too and can be swivelled in the direction of the adjustment plane, so that the same advantages as in the above described embodiments result.

This also applies to the embodiment given as an example in FIG. 5, where a frame 16 is located in a centered position in relation to the adjustment surface 1'', said frame 16 being either integrated into bearing 1 or simply set on top of adjustment surface 1''. Bolt 4 is supported pivotably in frame 16 and is held in a fork-shaped holding device 17 which reaches over said frame 16. The free end of adjustment screw 5 is inserted into holding device 17 and is secured against twisting by means of screw 6.

I claim:

1. An adjustment device for an operating element of a card or carding rollers, comprising:

a regulating element, the position of which is adjustable relative such card; and a bearing for the operating element, supported on a fixed guidance surface laterally defined by such card, and guided therealong for adjustment of said bearing, said bearing having an adjustment surface formed along the bottom thereof, substantially perpendicular to said fixed guidance surface and extending thereto, said adjustment surface being supported on said regulating element, and said bearing being adapted for movement along said guidance surface in an adjustment direction by means of position adjustment of said regulating element;

wherein said regulating element engages substantially symmetrically with said adjustment surface and parallel to said guidance surface for smooth, precise movement of said bearing ; and wherein said regulating element is pivotally mounted relative the card so as to be swivelled in an adjustment plane defined by said adjustment direction for compensating for any irregularities in the card operating element supported on said bearing.

2. An adjustment device as in claim 1, wherein:

said regulating element includes an adjustment screw; and said device further includes a rotatably installed bolt having a bore therein for receipt of an end of said adjustment screw.

3. An adjustment device as in claim 2, further comprising an adjustment head adapted for receipt of said rotatably installed bolt.

4. An adjustment device as in claim 3, wherein said adjustment head is in contact with said adjustment surface.

5. An adjustment device as in claim 3, wherein said adjustment head is formed as an integral component of said bearing, and said bolt received therein is in direct contact with said adjustment surface.

6. An adjustment device as in claim 5, wherein said bolt is provided with lateral rims.

7. An adjustment device as in claim 6, wherein said lateral rims are ground flat.

8. An adjustment device as in claim 6, wherein said lateral rims are crowned.

9. An adjustment device as in claim 2, wherein said bolt is cylindrical.

10. An adjusting device as in claim 2, wherein said bore comprises a threaded radial bore adapted for threadably receiving a free end of said adjustment screw.

11. An adjustment device as in claim 1, wherein:

said regulating element includes an adjustment screw; and said device further includes frame members disposed substantially symmetrically with respect to said adjustment surface, and adapted for rotatably supporting a pivotal bolt therein; and a holding device rigidly connected to said bolt via connection with said frame member, wherein said holding device is adapted for receipt of a free end of said adjustment screw.

12. An adjustment device as in claim 1, wherein:

said regulating element includes an adjustment screw; and said device further includes a single frame member which is substantially in a centered position in relation to said adjustment surface, and adapted for rotatably supporting a pivotal bolt therein; and a holding device which receives generally around said frame for holding same, wherein said holding device is adapted for receipt of a free end of said adjustment screw.

13. An adjustment device as in claim 1, wherein said regulating element includes an adjustment screw gripped in ball sockets mounted on a fixed portion of the card.

14. An adjustment apparatus for a carding machine element, comprising:

bearing means adapted for supporting the machine element, and laterally supported on a fixed guiding surface defined by a member of the carding machine and said bearing means being guided along said guiding surface for adjustment thereof, said bearing means further defining a subjacent adjustment surface substantially perpendicular to and extending to said fixed guiding surface; and regulating means, disposed beneath said bearing means and generally parallel to said guiding surface, for substantially symmetrically supporting said bearing means adjustment surface; wherein said regulating means is adapted for varying said support of said adjustment surface so as to smoothly and precisely selectively position said bearing means along said fixed guiding surface in an adjustment plane defined parallel to such guiding surface; and further wherein said regulating means are pivotally mounted relative the carding machine so as to be swivelled in said adjustment plane, whereby precision guidance and adjustment of the machine element to compensate for any irregularities thereof is made possible without jamming thereof during such adjustment.

15. An apparatus as in claim 14, wherein said regulating means comprises an adjustment screw having one end thereof threadably received in a radial bore of a bolt pivotably received in an adjustment head in contact with said adjustment surface.

16. An apparatus as in claim 15, wherein said adjustment head is integrally formed with said bearing means, and said bolt includes lateral rim portions thereof in direct contact with said adjustment surface.

17. An apparatus as in claim 15, further including a locking screw mounted transverse to said adjustment screw for selectively engaging same to prevent twisting thereof.

18. An apparatus as in claim 14, wherein said regulating means comprises an adjustment screw having one end thereof received in a holding device in turn associated with at least one frame member which is in contact with said adjustment surface.

19. An apparatus as in claim 18, further including a locking screw mounted transverse to said adjustment screw for selectively engaging same to prevent twisting thereof.

* * * * *